US006644557B1

(12) United States Patent
Jacobs

(10) Patent No.: US 6,644,557 B1
(45) Date of Patent: Nov. 11, 2003

(54) ACCESS CONTROLLED THERMOSTAT SYSTEM

(76) Inventor: Robert A Jacobs, 99 Cliff Rd., Belle Terre, NY (US) 11777

( * ) Notice: Subject to any disclaimer, the term of this patent is extended or adjusted under 35 U.S.C. 154(b) by 0 days.

(21) Appl. No.: 10/105,909

(22) Filed: Mar. 25, 2002

(51) Int. Cl.[7] ..... F24F 11/00; F23N 5/20

(52) U.S. Cl. ..... 236/46 R; 236/51; 340/825.31; 713/202

(58) Field of Search ..... 340/825.31; 236/46 R, 236/94, 51; 713/202

(56) References Cited

U.S. PATENT DOCUMENTS

| | | | | |
|---|---|---|---|---|
| 4,133,286 A | | 1/1979 | Linton | 236/94 |
| 4,403,646 A | | 9/1983 | Foders | 236/47 X |
| 4,663,951 A | | 5/1987 | Poulin | 70/168 |
| 4,843,084 A | | 6/1989 | Parker et al. | 236/1 B |
| 4,884,214 A | | 11/1989 | Parker et al. | 236/1 B |
| 5,530,230 A | | 6/1996 | Smith et al. | 219/723 |
| 5,682,475 A | | 10/1997 | Johnson et al. | 395/188.01 |
| 5,682,949 A | | 11/1997 | Ratcliffe et al. | 165/209 |
| 5,850,753 A | * | 12/1998 | Varma | 340/825.3 |
| 6,223,993 B1 | | 5/2001 | Lawrence | 236/49.3 |
| 6,241,156 B1 | | 6/2001 | Kline et al. | 236/49.3 |
| 6,260,765 B1 | | 7/2001 | Natale et al. | 236/47 |
| 6,496,937 B1 | * | 12/2002 | Ichihara | 713/202 |

* cited by examiner

*Primary Examiner*—William Wayner
(74) *Attorney, Agent, or Firm*—Michael I. Kroll

(57) ABSTRACT

A system for a user to control a thermostat temperature setting includes a master code by which an operator gains access to the system to set the parameters by which the general user can access the system and change the temperature setting. The general user gains access by keying in a password, which may be permanent or temporary, manipulating a key in a lock mechanism, or by providing a biometric reading through a biometric reading device. The biometric readings can include one or more characteristics including thumb print, finger print, retinal scan, iris scan, and facial image. The operator with the master code enables or disables the various means of access for the general user, and can also schedule automatic thermostat adjustments at various times and dates.

37 Claims, 5 Drawing Sheets

ACCESS CONTROLLED THERMOSTAT SYSTEM

BACKGROUND OF THE INVENTION

1. Field of the Invention

The present invention relates generally to thermostat security systems and more specifically to a thermostat security system that is access controlled to prevent unauthorized changing of temperature settings.

2. Description of the Prior Art

There are other thermostat security systems. Typical of these is U.S. Pat. No. 4,133,286 issued to Linton on Jan. 9, 1979.

Another patent was issued to Fodera on Sep. 13, 1983 as U.S. Pat. No. 4,403,646. Yet another U.S. Pat. No. 4,663,951 was issued to Poulin on May 12, 1987 and still yet another was issued on Jun. 27, 1989 to Parker et al. as U.S. Pat. No. 4,843,084.

Another patent was issued to Parker et al. on Nov. 28, 1989 as U.S. Pat. No. 4,884,214. Another patent was issued to Smith et al on Jun. 25, 1996 as U.S. Pat. No. 5,530,230. Another patent was issued to Johnson et al. on Oct. 28, 1997 as U.S. Pat. No. 5,682,475. Another patent was issued to Ratcliffe et al on Nov. 4, 1997 as U.S. Pat. No. 5,682,949. Another patent was issued to Lawrence on May 1, 2001 as U.S. Pat. No. 6,223,993 B1. Another patent was issued to Kline et al. on Jun 5, 2001 as U.S. Pat. No. 6,241,156 B1. Another patent was issued to Natale et al. on Jul. 17, 2001 as U.S. Pat. No. 6,260,765 B1.

U.S. Pat. No. 4,133,286

Inventor: Jonathan L. Linton

Issued: Jan. 9, 1979

An adjustable thermostat as disclosed having an adjustment stem journaled for rotation on the thermostat body for adjusting the operating temperature of the thermostat. Mounted on the adjusting stem is a pointer member formed of deformable material such as Nylon and providing a peripheral surface which engages with interference stationary surfaces on the thermostat body. Interengagement is provided between the peripheral surface and the stationary surfaces which causes deformation of the pointer member and creates friction resisting rotation of the pointer and of the adjusting stem. A detent-like structure is provided by flats formed on the peripheral surface of the pointer which mate with the corresponding surfaces of the body to tend to lock the pointer and in turn adjusting stem at a predetermined temperature.

U.S. Pat. No. 4,403,646

Inventor: Anthony W. Fodera

Issued: Sep. 13, 1983

A thermostat device for motels/hotels requiring the guest use a key to select a desired room temperature which in turn requires that the thermostat must be set back to a preset temperature when guest desires to lock the door to his motel/hotel room upon leaving the room.

U.S. Pat. No. 4,663,951

Inventor: Fernand H. Poulin

Issued: May 12, 1987

A security device for a thermostat comprising a housing for said thermostat, a lid member secured to the housing for movement between an opened position and a closed position, to gain and prevent access to the thermostat, respectively. The thermostat has a rotatable thermostat adjustment shaft extending exteriorly of the housing for manual manipulation thereof. A lock member is mounted in the housing for movement between a first position whereat the lock member lockingly engages the adjustment shaft to prevent rotation thereof and engages the lid member to prevent opening thereof and a second position whereat the lock member is disengaged from the adjustment shaft and the lid member permitting manual manipulation of the shaft or opening of the lid member and a key-operated actuating member disposed in the housing and extending exteriorly of the housing for displacing the lock member between its first and second positions.

U.S. Pat. No. 4,843,084

Inventor: Jeffrey L. Parker, et al.

Issued: Jun. 27, 1989

A microcomputer-controlled thermostat for use in monitoring and controlling a single zone HVAC system which provides conditioned air to one or more zones. The thermostat can be programmed and used either as a monitor thermostat to control the HVAC unit alone and/or to control the HVAC unit and its damper in a multiple zone mode. The thermostat is also programmed as a slave thermostat in a master-slave relationship with a monitor thermostat. The microcomputer memory is supplemented with additional ROM containing control algorithms for use in system operation. Logic circuitry is used to recognize commands as being for operation of the HVAC unit, the operation of the damper, or selection of which systems sensors are to be enabled. A real time clock circuit in the monitor thermostat is used to supply data for time-based system operation.

U.S. Pat. No. 4,884,214

Inventor: Jeffrey L. Parker, et al.

Issued: Nov. 28, 1989

A microcomputer-controlled thermostat for use in monitoring and controlling a single zone HVAC system which provides conditioned air to one or more zones. The thermostat can be programmed and used either as a monitor thermostat to control the HVAC unit alone and/or to control the HVAC unit and its damper in a multiple zone mode. The thermostat is also programmed as a slave thermostat in a master-slave relationship with a monitor thermostat. The microcomputer memory is supplemented with additional ROM containing control algorithms for use in system operation.

U.S. Pat. No. 5,530,230

Inventor: Andrew M. Smith, et al.

Issued: Jun. 25, 1996

A new variable password safety interlock system for microwave ovens and other computerized or electrical appliance allows the user to dynamically and automatically generate a new password immediately prior to each use. The variable password comprises some prearranged transposition or combination of numbers of digits that were already entered into the microwave control panel by the user. The user first enters digits representing the microwave time, the target food temperature, the microwave power level, the actual time of day on display or some other required combination of digits or microwave console buttons, and then presses the "Start" button. The new value of the variable password for that use of the microwave will be some prearranged transposition or combination of the digits, numbers or buttons that had just previously been pressed by the user and that appeared on the microwave control panel at the moment the user pressed the "Start" button. Preferably, the password is the digits of the microwave heating time just entered by the user but in reverse order. The password does not require memorization and is easy for the user to compute because the numbers are on display to the user. This password safety interlock is child-proof because a young child will be unable to compute the ephemeral and varying password needed to operate the microwave.

U.S. Pat. No. 5,682,475

Inventor: William J. Johnson, et al.

Issued: Oct. 28, 1997

A method and system are provided for controlling access to a data processing system through the use of a variable password. In one embodiment, the invention substitutes the value of a variable into an expression contained in a predefined password, evaluates the expression and password, and compares the result of the valuation of the password to a character string input to the data processing system, granting access if they are identical. A range of values of certain characters of the password may be permitted. The password may require that certain characters be entered within a defined time interval measured from the entry of other characters. The values of environment variables, which are referenced by the variable password, may change from time to time, as a function, for example, of the current time or temperature or system utilization.

U.S. Pat. No. 5,682,949

Inventor: Edward L. Ratcliffe, et al.

Issued: Nov. 4, 1997

This document describes an energy management system in which microprocessor based thermostats are used to control individual room temperatures in a multiple room building in accordance with the known occupancy status of the room. The occupancy status information, as well as other control parameters, are transmitted to the thermostats from a central computer program. The control of a heating and cooling appliances is performed by an algorithm running on the electronic thermostat, which performs this function in accordance with these downloaded parameters. The system, allows room occupants to control the temperature of an occupied room within preset limits, automatically limits energy usage in unoccupied rooms, and provides additional facilities for energy management and general building management.

U.S. Pat. No. 6,223,993 B1

Inventor: Walter C. Lawrence

Issued: May 1, 2001

A climate control system is provided including a vacuum pump for generating a vacuum upon actuation. Also included is a thermostat for generating the activation signal upon a current temperature within the associated room being out of a predetermined range. At least one vent assembly is provided including a plurality of vanes pivotally mounted within the frame and having an unbiased open orientation for allowing the flow of air into the associated room and a biased closed orientation for precluding the flow of air into the associated room and a pneumatic servo connected to each of the vanes and in communication with the vacuum pump. The servo is adapted to transfer the vanes of the vent assembly to the closed orientation thereof only upon the receipt of vacuum. Finally, a vacuum valve is connected between the vacuum pump and the servo of the vent assembly. Such vacuum valve is connected to the thermostat for supplying the same with a vacuum during the receipt of the activation signal.

U.S. Pat. No. 6,241,156 B1

Inventor: James R. Kline, et al.

Issued: Jun. 5, 2001

An apparatus and process for individual adjustment of an operating parameter of a plurality of environmental control devices, such as VAV devices in an HVAC system. The process includes the step of connecting at least one of computers for input of a parameter control set point based signal and a unique VA device identifying signal through an Internet website to the plurality of HVAC devices. The computer is, for example, connected to the VAV devices such that the computer can be used to adjust the temperature set point of only one of the plurality of VAV devices, most typically the device located in the same space as the communicating computer. Such computer can be wired or wireless, and use the global computer network website to connect to the VAV devices through a building computer and local area network. In the preferred form, the computers are also capable of retrieving the current temperature set point from the VAV device and the current room air temperature proximate the VAV device, outputting or displaying them on a computer output or display device, and U.S. Pat. No. 6,241,156 B1

Inventor: James R. Kline, et al.

Issued: Jun. 5, 2001

An apparatus and process for individual adjustment of an operating parameter of a plurality of environmental control devices, such as VAV devices in an HVAC system. The process includes the step of connecting at least one of computers for input of a parameter control set point based signal and a unique VA device identifying signal through an Internet website to the plurality of HVAC devices. The computer is, for example, connected to the VAV devices such that the computer can be used to adjust the temperature set point of only one of the plurality of VAV devices, most typically the device located in the same space as the communicating computer. Such computer can be wired or wireless, and use the global computer network website to connect to the VAV devices through a building computer and local area network. In the preferred form, the computers are also capable of retrieving the current temperature set point from the VAV device and the current room air temperature proximate the VAV device, outputting or displaying them on a computer output or display device, and U.S. Pat. No. 6,260,765 B1

Inventor: Nicholas A. Natale

Issued: Jul. 17, 2001

A thermostat system for controlling activation of a temperature management system is operable in an energy-savings mode for enhancing energy savings and in a comfort mode for enhancing comfort, where the operating mode is selectable by a user. The thermostat system has operating mode control circuitry which includes (1) a manual mode control operable to cause the operating mode control circuit to switch between the energy-savings and the comfort states when pressed by the user, (2) a wireless receiver for receiving a wireless mode switching signal that causes the operating mode switching circuitry to switch between the energy-savings and the comfort states, and (3) telephone communication circuitry for receiving a telephonic mode switching signal that causes the operating mode switching circuitry to switch between the energy-savings and the comfort states. Thus, the present invention offers at least three convenient ways for the user to switch between energy-savings and comfort modes of operation. A temperature sensor senses the temperature of the air space and produces a sensed temperature signal based on the temperature of the air space. A controller produces an under-temperature signal when the sensed temperature signal indicates that the temperature is less than a minimum temperature and an over-temperature signal when the sensed temperature signal indicates that the temperature is greater than a maximum temperature. When the under-temperature or over-temperature signal is produced, the telephone communication circuitry places a telephone call to a telephone number of a designated receiving telephone to give a warning concerning the over- or under-temperature condition.

SUMMARY OF THE PRESENT INVENTION

A primary object of the present invention is to provide an access controlled thermostat.

Another object of the present invention is to provide an access controlled thermostat designed to protect from unauthorized changing of a thermostat temperature setting.

Yet another object of the present invention is to provide an access controlled thermostat that would be required prior to changing the settings of the temperature.

Still yet another object of the present invention is to provide a thermostat with password security that the password may be changed at any time by the operator using a master code.

Yet another object of the present invention is to provide a thermostat with password security that temporary password codes can be issued to other people that are only valid for a pre-determined amount of time.

Yet another object of the present invention is to provide a thermostat system that includes a biometric reading device that require biometric input to gain access to the thermostat for changing the temperature setting.

Another object is to provide a thermostat that can respond to keyed manipulation of a lock mechanism if pre-authorized by the operator using the master code in the authorization process.

Additional objects of the present invention will appear as the description proceeds.

The present invention overcomes the shortcomings of the prior art by providing a thermostat access system that is programmed by an operator with a master code to include the optimal types of thermostat access that is dictated by the circumstances. The master code allows the operator to set the system to take passwords, biometric readings, or a lock and key mechanism to access the thermostat to change the temperature setting. If only one method is appropriate at a particular time, the operator can limit the system to accept only that method of access. If a different method is more applicable on a different occasion the operator with the master code can enable only that different method. Passwords can be ongoing until deliberately terminated, or can be temporary with a programmed duration before automatic invalidation.

A system is provided for a user to control a thermostat temperature setting, comprising: a housing component enclosing the thermostat, the housing and thermostat being positioned on a hand-accessible wall; at least one display component for displaying temperature information and control information, the temperature information including at least the actual temperature, the control information including at least prompts and messages; an access controller component having: a plurality of user-operated keys, the keys including at least a plurality of numeric keys; a memory for storing and accessing information entered by the user, the information including at least a master code and a password; the access controller component being operative to: accept a password, the password being keyed in by the user, the display then prompting the user to key in a new thermostat temperature setting if the password matches a password stored in the memory; reject a keyed in password if said password does not match a stored password, the display communicating the rejection; communicate the keyed in new thermostat temperature setting to the thermostat, the thermostat being adapted to adjust the temperature setting in response to the communication; and accept a keyed in master code if the keyed in master code matches the master code stored in the memory, the display then prompting the master code user to key in the user's choice of the access controller component functions the user desires to modify, and further prompting for keyed in entries to make those modifications, the available modifications at least including: modifying the acceptable passwords by adding new passwords or eliminating then stored passwords; and reject a keyed in master code if the keyed in master code does not match the master code stored in the memory.

A system is provided for a user to control a thermostat temperature setting, comprising: a housing component enclosing the thermostat, the housing and thermostat being positioned on a hand-accessible wall; at least one display component for displaying temperature information and control information, the temperature information including at least the actual temperature, the control information including at least prompts and messages; an access controller component having: a plurality of user-operated keys, the keys including at least a plurality of numeric keys; a biometric reading device for receiving biometric information from the user; a memory for storing and accessing information entered by the user, the information including at least a master code, a password, and a biometric record of the user; the access controller component being operative to: accept a password, the password being keyed in by the user, the display then prompting the user to key in a new thermostat temperature setting if the password matches a password stored in the memory; reject a keyed in password if said password does not match a stored password, the display communicating the rejection; accept a biometric reading and compare the reading to the stored biometric record, the display then prompting the user to key in a new thermostat temperature setting if the biometric reading matches a biometric record stored in the memory; reject a biometric reading if said reading does not match the stored biometric record of the user, the display communicating the rejection; communicate the keyed in new thermostat temperature setting to the thermostat, the thermostat being adapted to adjust the temperature setting in response to the communication; and accept a keyed in master code if the keyed in master code matches the master code stored in the memory, the display then prompting the master code user to key in the user's choice of the access controller component functions the user desires to modify, and further prompting for keyed in entries to make those modifications, the available modifications at least including: modifying the acceptable passwords by adding new passwords or eliminating then stored passwords; and modifying the biometric record by adding new biometric records or eliminating then stored biometric records; reject a keyed in master code if the keyed in master code does not match the master code stored in the memory.

In another embodiment, modification of acceptable passwords includes at least the options of: adding a new password; eliminating a stored password; adding a temporary password, and information determining its duration; and eliminating a temporary password, and information determining its duration.

In another embodiment, the available modification to the master code user also includes: setting the time; setting the date; and setting a schedule wherein the thermostat temperature setting is adjusted at various times and dates keyed-in by the master code user.

In another embodiment, the access controller component has a clearing key that, when depressed, restores the system to the un-accessed status.

In another embodiment, the access controller component is further operative to prompt for a keyed-in selection of the user's choice of password access or biometric access.

In another embodiment, the access controller component further comprises a general access key that, when depressed causes the access controller component to prompt for a keyed-in selection of the user's choice of password access or biometric access.

In another embodiment, the access controller component further comprises a master access key that, when depressed causes the access controller component to prompt for the master code to be keyed-in.

In another embodiment, the access controller component biometric reading is a thumb print, the access controller component having a biometric reading device for the thumb to contact, the device reading the thumb print and communicating the biometric reading for the comparison to the biometric record.

In another embodiment, the access controller component biometric reading is a finger print, the access controller component having a biometric reading device for the finger to contact, the device reading the finger print and communicating the biometric reading for the comparison to the biometric record.

In another embodiment, the access controller component biometric reading is a retinal scan, the access controller having a biometric reading device into which the user's close gaze is directed, the device reading the retinal scan and communicating the biometric reading for the comparison to the biometric record.

In another embodiment, the access controller component biometric reading is an iris scan, the access controller having a biometric reading device into which the user's close gaze is directed, the device reading the iris scan and communicating the biometric reading for the comparison to the biometric record.

In another embodiment, the access controller component biometric reading is a voice pattern, the access controller having a biometric reading device into which the user's voice is directed, the device reading the voice pattern and communicating the biometric reading for the comparison to the biometric record.

In another embodiment, the access controller component biometric reading is a facial image, the access controller having a biometric reading device at which the user's face is presented, the device reading the facial image and communicating the biometric reading for the comparison to the biometric record.

In another embodiment, the access controller component also has a lock mechanism and a key for manipulating the lock mechanism, the stored and accessible memory information includes an on or off status for the lock mechanism, and the access controller component is operative to: accept a keyed manipulation of the lock mechanism if the stored lock mechanism information indicates the lock mechanism is on, the display then prompting the user to key in a new thermostat temperature setting; and reject a keyed manipulation of the lock mechanism if the stored information indicates the lock mechanism is off, the display communicating the rejection.

In another embodiment, the available modifications to the master code user also includes changing the on or off status for the lock mechanism.

In another embodiment, the access controller component further comprises a general access key that, when depressed causes the access controller component to prompt for a keyed-in selection of the user's choice of password access, biometric access, or key access.

A system is provided for a user to control a thermostat temperature setting, comprising: a housing component enclosing the thermostat, the housing and thermostat being positioned on a hand-accessible wall; display means for displaying temperature information and control information, the temperature information including at least the actual temperature, the control information including at least prompts and messages; access control means for controlling access to the thermostat, the access control means having: a plurality of user-operated keys, the keys including at least a plurality of numeric keys; biometric reading means for receiving biometric information from the user; memory means for storing and accessing information entered by the user, the information including at least a master code, at least one password, and a biometric record of the user; the access control means being operative to: accept a password, the password being keyed in by the user-operable keys, the display means then prompting the user to key in a new thermostat temperature setting if the password matches a password stored in the memory; reject a keyed in password if said password does not match a stored password, the display means communicating the rejection; accept a biometric reading and compare the reading to the stored biometric record, the display means then prompting the user to key in a new thermostat temperature setting if the biometric reading matches a biometric record stored in the memory; reject a biometric reading if said reading does not match a stored biometric record of the user, the display means communicating the rejection; communicate the keyed in new thermostat temperature setting to the thermostat, the thermostat being adapted to adjust the temperature setting in response to the communication; accept a keyed in master code if the keyed in master code matches the master code stored in the memory, the display means then prompting the master code user to key in the user's choice of the access controller function the user desires to modify, and further prompting for keyed in entries to make those modifications, the available modifications at least including: modifying the acceptable passwords by adding new passwords or eliminating then stored passwords; and modifying the biometric record by adding new biometric records or eliminating then stored biometric records; reject a keyed in master code if the keyed in master code does not match the master code stored in the memory.

In another embodiment, modification of acceptable passwords includes at least the options of: adding a new password; eliminating a stored password; adding a temporary password, and information determining its duration; and eliminating a temporary password, and information determining its duration.

In another embodiment, the available modification to the master code user also includes: setting the time; setting the date; and setting a schedule wherein the thermostat temperature setting is adjusted at various times and dates keyed-in by the master code user.

In another embodiment, the access control means has a clearing key that, when depressed, restores the system to the un-accessed status.

In another embodiment, the access control means is further operative to prompt for a keyed-in selection of the user's choice of password access or biometric access.

In another embodiment, the access control means further comprises a general access key that, when depressed causes the access control means to prompt for a keyed-in selection of the user's choice of password access or biometric access.

In another embodiment, the access control means further comprises a master access key that, when depressed causes the access control means to prompt for the master code to be keyed-in.

In another embodiment, the access control means biometric reading is a thumb print, the access control means having a biometric reading device for the thumb to contact, the device reading the thumb print and communicating the biometric reading for the comparison to the biometric record.

In another embodiment, the access control means biometric reading is a finger print, the access control means having a biometric reading device for the finger to contact, the device reading the finger print and communicating the biometric reading for the comparison to the biometric record.

In another embodiment, the access control means biometric reading is a retinal scan, the access controller having a biometric reading device into which the user's close gaze is directed, the device reading the retinal scan and communicating the biometric reading for the comparison to the biometric record.

In another embodiment, the access control means biometric reading is an iris scan, the access controller having a biometric reading device into which the user's close gaze is directed, the device reading the iris scan and communicating the biometric reading for the comparison to the biometric record.

In another embodiment, the access control means biometric reading is a voice pattern, the access controller having a biometric reading device into which the user's voice is directed, the device reading the voice pattern and communicating the biometric reading for the comparison to the biometric record.

In another embodiment, the access controller component biometric reading is a facial image, the access controller having a biometric reading device at which the user's face is presented, the device reading the facial image and communicating the biometric reading for the comparison to the biometric record.

In another embodiment, the access control means also has a lock mechanism and a key for manipulating the lock mechanism, the stored and accessible memory information includes an on or off status for the lock mechanism, and the access control means is operative to: accept a keyed manipulation of the lock mechanism if the stored lock mechanism information indicates the lock mechanism is on, the display means then prompting the user to key in a new thermostat temperature setting; reject a keyed manipulation of the lock mechanism if the stored information indicates the lock mechanism is off, the display means communicating the rejection.

In another embodiment, the available modifications to the master code user also includes changing the on or off status for the lock mechanism.

In another embodiment, the access control means further comprises a general access key that, when depressed causes the access control means to prompt for a keyed-in selection of the user's choice of password access, biometric access, or key access.

A method is provided to control access to a thermostat at least one user in accordance with parameters set by of an operator, the thermostat being enclosed in a housing, and a controller being in electronic communication with the thermostat, in electronic communication with at least one display for displaying alphanumeric characters, and in electronic communication with user-operable keys, the controller being programmable and having a memory, the method comprising the steps of: accepting a master code as entered by the operator using the keys; allowing access to the controller memory if the master code is valid; accepting the operator's choice of one function from a plurality of functions for which function parameters are to be changed, including at least the functions of setting a permanent password, setting a temporary password and its duration parameters, and setting biometric access parameters; if the operator chose setting a permanent password, prompting for keypad entry of at least one permanent password; accepting the operator's keypad entry of the at least one permanent password and storing the at least one permanent password in the memory; if the operator chose setting a temporary password, prompting for keypad entry of at least one temporary password and duration determinative keypad entries for each of the at least one temporary passwords; accepting the operator's keypad entry of the at least one temporary password and duration determinative entries and storing the at least one temporary password and duration determinative entries in the memory; if the operator chose setting biometric reading parameters, prompting for a biometric reading of a biometric characteristic of the at least one intended user; accepting the biometric reading and storing the biometric reading in the memory as a biometric record; controlling access to keypad entry of a thermostat temperature setting by a user by: accepting the user's keypad entry of a password, if the entered password matches a stored permanent or temporary password, then accepting a keypad entry of a new thermostat temperature setting; rejecting the user's keypad entry of a password, if the entered password does not match either a stored permanent or temporary password, then displaying the rejection; accepting the user's provision of a biometric reading, if the biometric reading matches a stored biometric record, then accepting a keypad entry of a new thermostat temperature setting; rejecting the user's provision of a biometric reading, if the biometric reading does not match a stored biometric record.

In another embodiment, a lock mechanism is in electronic communication with the controller and the functions for which parameters are changeable by the operator also include setting the controller to accept or reject a keyed manipulation of a lock mechanism such that the controller accepts a keyed manipulation of the lock mechanism by the user if the operator has set the controller to accept the same, and rejects the keyed manipulation of the lock mechanism by the user if the operator has set the controller to reject the same.

In another embodiment, the functions for which parameters are changeable by the operator also include: setting the time; setting the date; and setting a schedule wherein the thermostat temperature setting is adjusted at various times and dates keyed-in by the operator.

A system is provided for a user to control a thermostat temperature setting, comprising: a housing component enclosing the thermostat, the housing and thermostat being positioned on a hand-accessible wall; at least one display component for displaying temperature information and control information, the temperature information including at least the actual temperature, the control information including at least prompts and messages; an access controller component having: a plurality of user-operated keys, the keys including at least a plurality of numeric keys; a biometric reading device for receiving biometric information from the user; a lock mechanism and a key for manipulating the lock mechanism, the stored and accessible memory information includes an on or off status for the lock mechanism; a memory for storing and accessing information entered by the user, the information including at least a master code, a password, a biometric record of the user, an on or off status for the lock mechanism, a system time, a system date, a system schedule; the access controller component being operative to: accept a password, the password being keyed in by the user, the display then prompting the user to key in a new thermostat temperature setting if the password matches a password stored in the memory; reject a keyed in password if said password does not match a stored password, the display communicating the rejection; accept a biometric reading and compare the reading to the stored biometric record, the display then prompting the user to key in a new thermostat temperature setting if the biometric reading matches a biometric record stored in the memory; reject a biometric reading if said reading does not match the stored biometric record of the user, the display communicating the rejection; accept a keyed manipulation of the lock mechanism if the stored lock mechanism information indicates the lock mechanism is on, the display then prompting the user to key in a new thermostat temperature setting; and reject a keyed manipulation of the lock mechanism if the stored information indicates the lock mechanism is off, the display communicating the rejection; communicate the keyed in new thermostat temperature setting to the thermostat, the thermostat being adapted to adjust the temperature setting in response to the communication; and accept a keyed in master code if the keyed in master code matches the master code stored in the memory, the display then prompting the master code user to key in the user's choice of the access controller component functions the user desires to modify, and further prompting for keyed in entries to make those modifications, the available modifications at least including: modifying the acceptable passwords by adding new passwords, eliminating then stored passwords, adding a temporary password and information determining its duration; modifying the biometric record by adding new biometric records or eliminating then stored biometric records; and modifying the on or off status of the lock mechanism; modifying the system time; modifying the system date; modifying the system schedule such that the thermostat temperature setting is automatically adjusted at various times and dates; and reject a keyed in master code if the keyed in master code does not match the master code stored in the memory.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

DESCRIPTION OF THE REFERENCED NUMERALS

Figure 1:
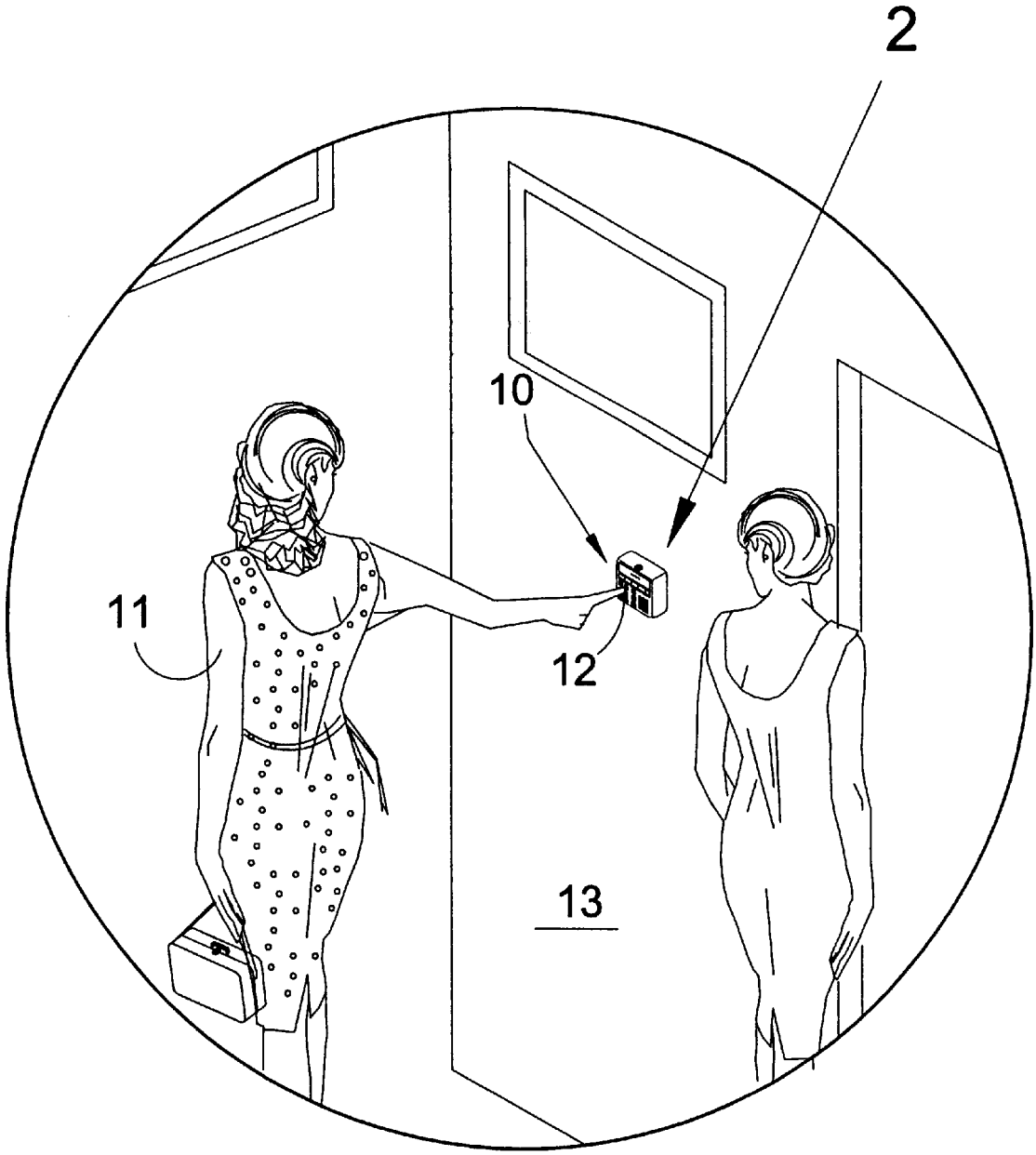
FIG. 1 is an illustrative view of the present invention in use. The access controlled thermostat has a housing, and is typically mounted on a wall surface.

Turning now descriptively to the drawings, in which similar reference characters denote similar elements throughout the several views, the figures illustrate the Access Controlled Thermostat System of the present invention. With regard to the reference numerals used, the following numbering is used throughout the various drawing figures.

| | |
|---|---|
| 10 | Access Controlled Thermostat System of the present invention |
| 11 | user |
| 12 | user finger |
| 13 | wall surface |
| 14 | user thumb |
| 20 | housing |
| 22 | keypad |
| 24 | numeric keys |
| 26 | "ADJUST THERMOSTAT" key |
| 28 | "MASTER" key |
| 30 | "CLEAR" key |
| 32 | up arrow key |

-continued

| | |
|---|---|
| 34 | down arrow key |
| 36 | lock mechanism |
| 38 | biometric reading device |
| 40 | control display |
| 42 | temperature display |
| 44 | "YES" key |
| 46 | "NO" key |
| 50 | step - press MASTER key |
| 52 | step - prompt for master code |
| 54 | step - validate master code |
| 56 | step - display error and prompt for retry or quit |
| 58 | step - check retry count |
| 60 | step - terminate process |
| 62 | step - prompt for system function to be modified |
| 64 | step - "Set Permanent Password(s)" function selected |
| 66 | step - "Set Time" function selected |
| 68 | step - "Set Temporary Password(s)" function selected |
| 70 | step - "Set Date" function selected |
| 72 | step - "Set Biometric Access Parameters" function selected |
| 74 | step - "Set Schedule" function selected |
| 76 | step - "Set Key Access" function selected |
| 78 | step - "Set Retry Counter" function selected |
| 80 | step - prompt for keypad entry of password(s) |
| 82 | step - prompt for option to set other functions |
| 84 | step - prompt for keypad entry of time |
| 86 | step - prompt for keypad entry of password(s) and duration |
| 88 | step - prompt for keypad entry of date |
| 90 | step - prompt with instructions for enabling biometric access |
| 92 | step - prompt for keyword entry of thermostat adjustment schedule |
| 94 | step - prompt for keypad entry of key access ON-OFF |
| 96 | step - prompt for keypad entry of retry counter number |
| 98 | step - press "ADJUST THERMOSTAT" |
| 100 | step - prompt for selection of access method |
| 102 | step - password access method selected |
| 104 | step - biometric access method selected |
| 106 | step - key access method selected |
| 108 | step - prompt for password entry from keypad |
| 110 | step - validate entered password |
| 112 | step - display error message and prompt for retry |
| 114 | step - terminate process |
| 116 | step - check retry count |
| 118 | step - prompt for new thermostat temperature setting entry from keypad |
| 120 | step - prompt for appropriate biometric reading |
| 122 | step - validate biometric reading |
| 124 | step - prompt for key insertion and turning |
| 126 | step - check key access allowed |
| 128 | step - display error message |

DETAILED DESCRIPTION OF THE PREFERRED EMBODIMENTS

The following discussion describes in detail the preferred embodiments of the invention. This discussion should not be construed, however, as limiting the invention to those particular embodiments. Practitioners skilled in the art will recognize numerous other embodiments as well. For a definition of the complete scope of the invention, the reader is directed to the appended claims.

Figure 2:
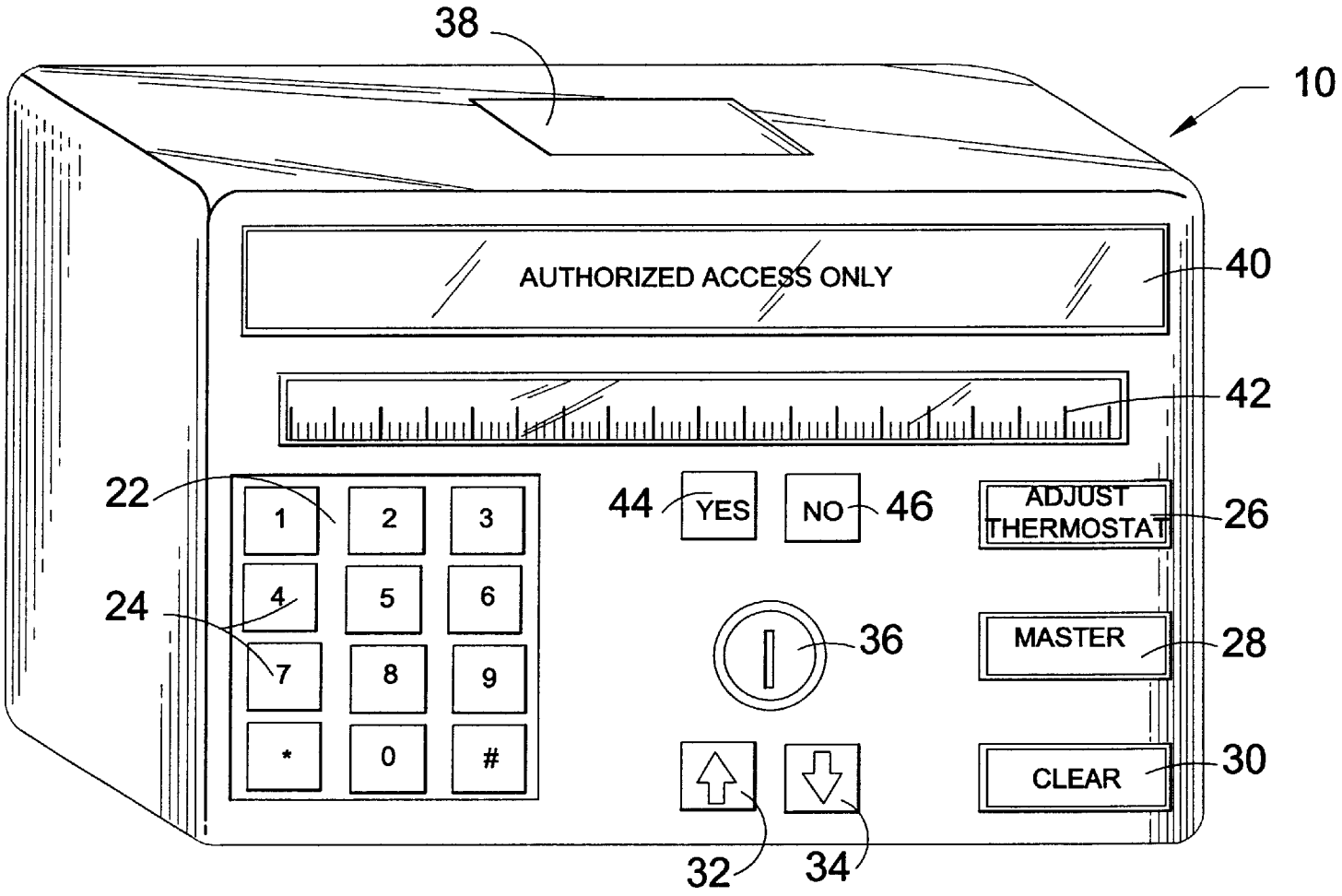
FIG. 2 is a frontal perspective of the preferred embodiment of the present invention.
Figure 3:
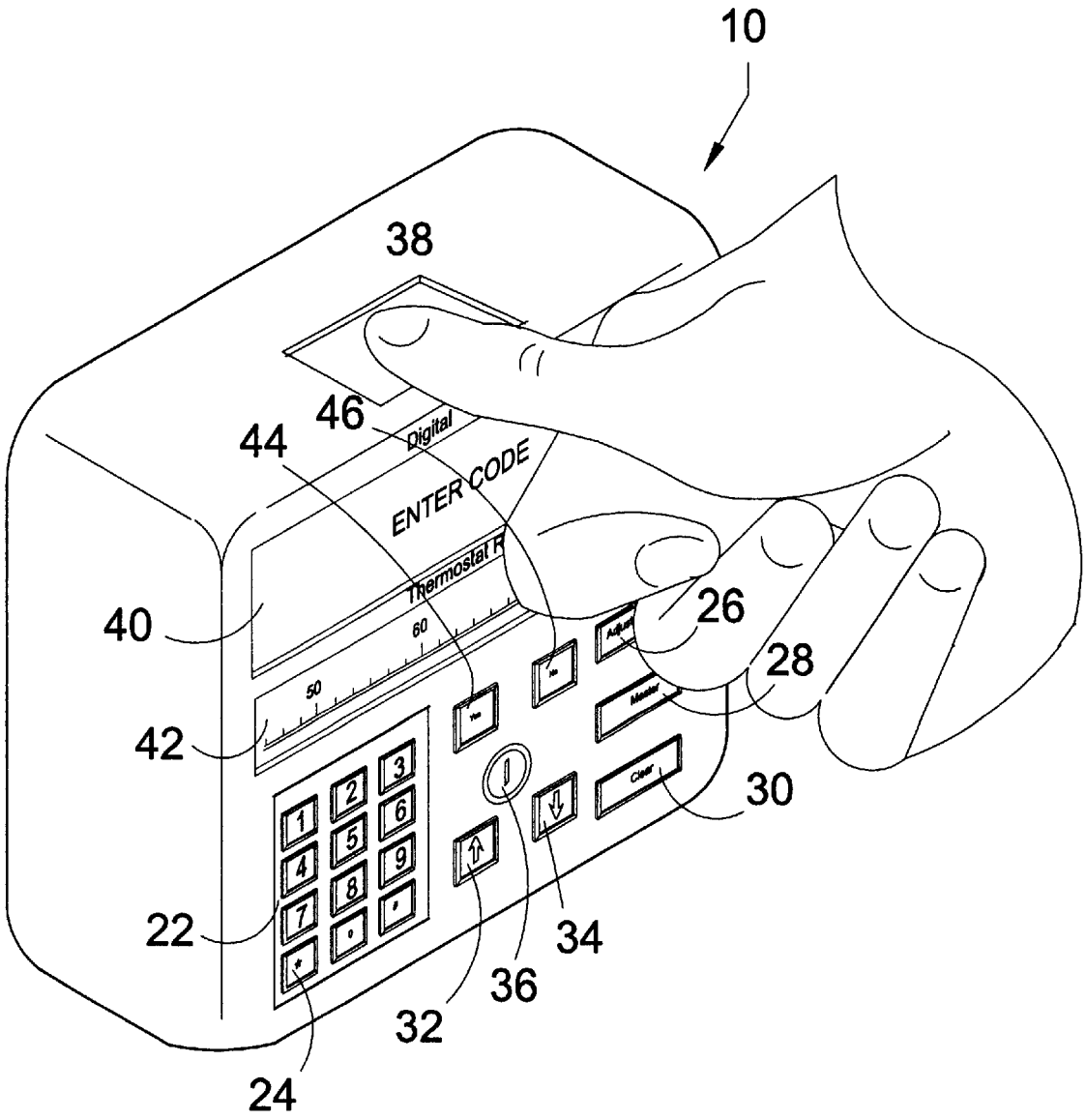
FIG. 3 is a perspective view of the present invention with the user's thumb on the biometric reading device.

FIGS. 1–3 depict the preferred embodiment of the Access Controlled Thermostat System 10, with FIG. 1 illustrating a user 11 operating the system 10 using her finger 12. A typical installation on a wall 13 is also shown in FIG. 1. FIG. 3 depicts the user's thumb 14 being used with regard to certain system 10 features described below.

FIG. 2 depicts a frontal perspective view of the system 10. A housing 20 encloses a thermostat that is conventionally connected to a typical air conditioning unit for cooling or heating a building. The system 10 has no external levers or other mechanically initiated means for setting the temperature at which the thermostat will start or terminate the operation of the air conditioning unit.

In the present invention the temperature setting is only adjustable by those that have been designated. A controller is provided for communicating with and setting the temperature on the thermostat, the controller being programmed to respond to input signals from external controls on the housing 20, including, a numeric key pad 22 having numerically assigned keys 24, an "ADJUST THERMOSTAT" key 26, a "MASTER" key 28, a "CLEAR" key 30, up and down arrow keys 32,34, a lock mechanism 36, and a biometric reading device 38 for reading a thumb print. A control display 40 and a temperature display 42 are present on the front of the housing 20.

The controller can be constructed using the conventional central processing unit technology that is common in office machines, handheld game devices, and other electronic devices that receive keyed information from the user. The controller has an accessible memory for storing inputted information.

The user 11 reviews the temperature display 42 to determine the actual room temperature and the current thermostat setting. The control display 40 will display text to inform the user 11 of the required steps necessary to change the thermostat setting. Both displays 40,42 are LCD displays, although other display mechanisms are contemplated in other embodiments. For example, the temperature display 42 can include mechanical needle indicators that are typically associated with a conventional thermostat.

Figure 4:
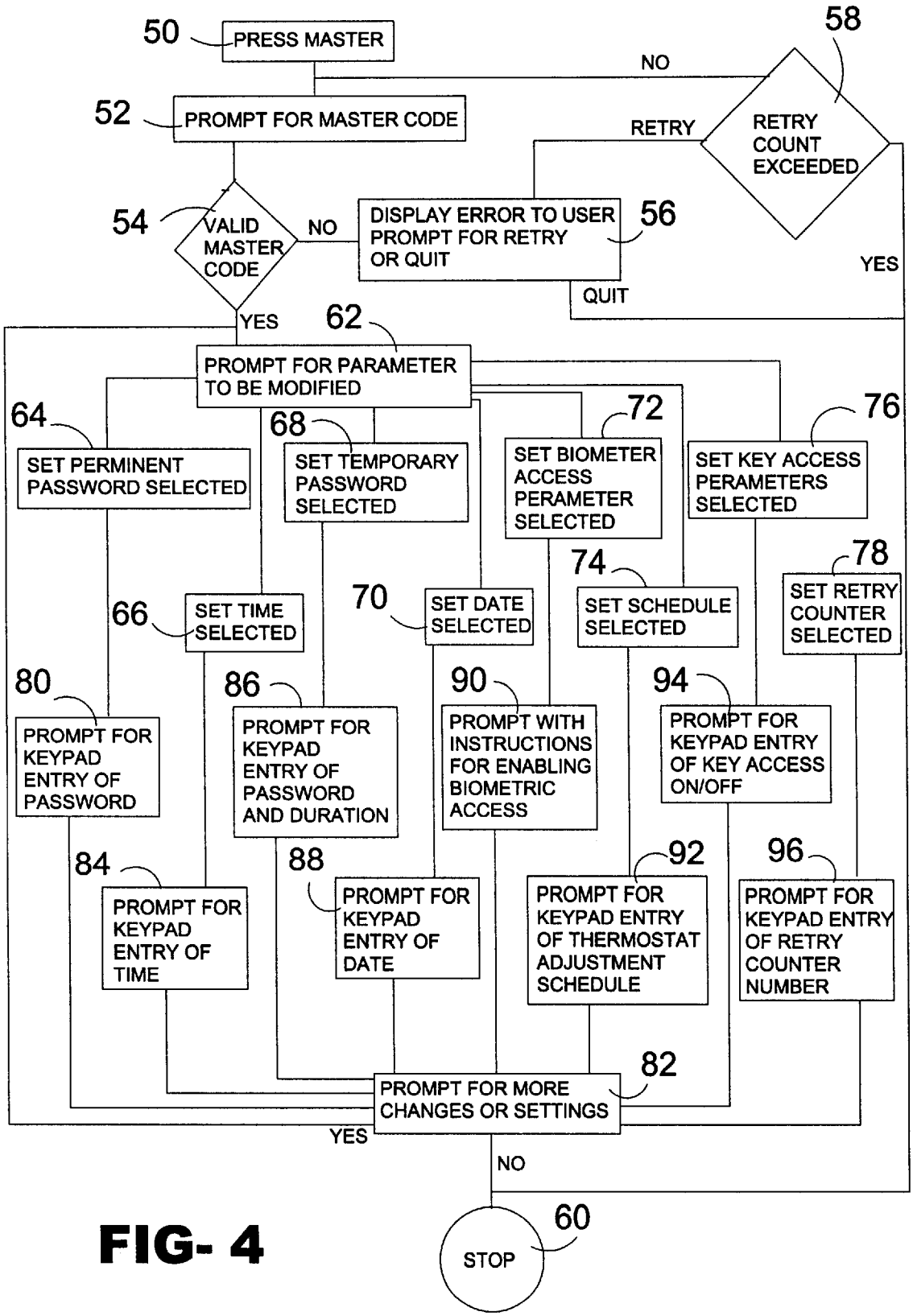
FIG. 4 is a block diagram depicting the operator's use of the master code to enable various methods of accessing the thermostat and/or to modify the parameters of various system functions.

The present invention provides multiple modes of access to the thermostat temperature setting status, all controlled and set by the user 11 having the master code. To initiate the operation of the Access Controlled Thermostat System 10, the user 11 completes a series of steps, as shown in FIG. 4. The user 11 depresses 50 the master key 28 causing the controller to prompt 52 for the master code to be keyed in using the numeric keys 24.

The controller is programmed to recognize the master code and determine 54 if the entered master code is valid. If an invalid master code is entered an error message is displayed 56, and the controller then determines 58 if the number of attempts to enter a correct master code exceeds a preset number. If the maximum number of master code entry attempts has not been exceeded then the controller then causes the control display 40 to prompt 52 for the master code again. If the maximum number has been exceeded the controller terminates 60 the process.

Once a valid master code has been entered the controller causes the control display 40 to prompt 62 for the user to choose among the numerous user-programmable functions 64,66,68,70,72,74,76,78, each function having a displayed number associated with the function, such that the user 11 selects the function he or she wishes to perform by pushing the associated number on the keypad 22. These functions include adding or deleting 64 permanent passwords, setting 66 system time, adding or deleting 68 temporary passwords with duration determinative settings included, setting 70 the system date, setting 72 biometric access parameters, setting 74 the schedule, including one or more adjustments in the thermostat temperature setting at various scheduled times, setting 76 the controller to allow access in response to a designated key manipulating the lock mechanism 36, and setting 78 the number of master code entry retries.

The user 11 who selects the "Set Permanent Password(s)" keys in the number associated with this function 64 as indicated on the control display 40. The controller then causes the control display 40 to prompt 80 for the keypad 22 entry of new or additional passwords that will remain as valid passwords until deleted. In the execution of this prompt function 80 the control display 40 will also allow review of existing permanent passwords with an opportunity to key in a numeric delete command. Once the user 11 has successfully entered or deleted permanent passwords, the controller causes the control display 40 to prompt 82 for an indication as to whether the user 11 wants to modify additional parameters in other functions. In the preferred embodiment 10, a "YES" key 44 and a "NO" key 46 are provided, although the control display 40 can also include a numeric key 24 entry for either response. If the user 11 selects "NO" the controller terminates the parameter modification process. If the user 11 selects "YES" the controller returns to the prompt 62 for another function to be chosen.

If the user 11 chooses the "Set Time" function 66, the controller causes the control display 40 to prompt 85 for keypad 22 entry of the correct time. Once the time is entered by the user 11, the control display 40 prompts 82 for a decision as to whether to modify the parameters for another function.

When the user 11 selects the "Set Temporary Password (s)" function 68 the controller causes the control display 40 to prompt for the keypad 22 entry of new or additional passwords that will remain as valid passwords for only an amount of time specified by the user 11 as the temporary password is added. In the execution of this prompt function 86 the control display 40 will also allow review of existing temporary passwords with an opportunity to key in a numeric delete command or a change in the duration.

The "Set Date" function 70 is one of the functions that can be selected by the user 11 at the prompt 54 for choosing the function for which parameters are to be modified. Once this function 70 is chosen, the controller causes the control display 40 to prompt 88 for the keypad 22 entry of the correct date. Once the date is keyed in the prompt 82 is again displayed, offering the user 11 the option to move to other functions to review or modify.

If the user 11 chooses the "Set Biometric Access Parameters" function 72, the controller causes the control display 40 to prompt 90 for the entry of a biometric record to be stored in the controller memory. A biometric record must be stored for each user 11 for which such access will be provided. In the preferred embodiment 10, each such user 11 places his or her thumb on the biometric reading device 38 and the scanned thumb print is stored. The control display 40 will indicate that the reading has been successfully recorded and, after all users 12 have had their thumb print recorded, the control display 40 again prompts 82 for an indication as to whether the user 11 wants to modify another function's parameters.

If the "Set Schedule" function 74 is selected by the user 11, the controller causes the control display 40 to prompt 92 for the dates, times, and temperature settings, which the user 11 wishes to schedule, thus providing an advance scheduling of automatic thermostat adjustments.

When the user 11 selects the "Set Key Access Parameters" function 76, the controller causes the control display 40 to prompt 94 for the an "ON" or "OFF" keypad 22 entry. When an "ON" entry is keyed in, the controller will recognize the manipulation of the lock mechanism 36 by an appropriate key, and allow access to the thermostat temperature setting function. When an "OFF" entry is keyed in, the controller will reject the manipulation of the lock mechanism 36, even by a key that would otherwise manipulate the lock mechanism 36.

If the user 11 selects the "Set Retry Counter" function 78, the controller causes the control display 40 to prompt 96 for a keypad 22 entry of a number that reflects the number of times the user 11 can attempt to gain access to the thermostat temperature setting function.

When the user 11 has set or modified the parameters for functions that he or she desires, the user 11 will respond with a "NO" response to the prompt 82 for "More Changes or Settings" and the controller will terminate the master code user's modification process. The system 10 is then ready for normal access procedures by authorized persons.

Figure 5:
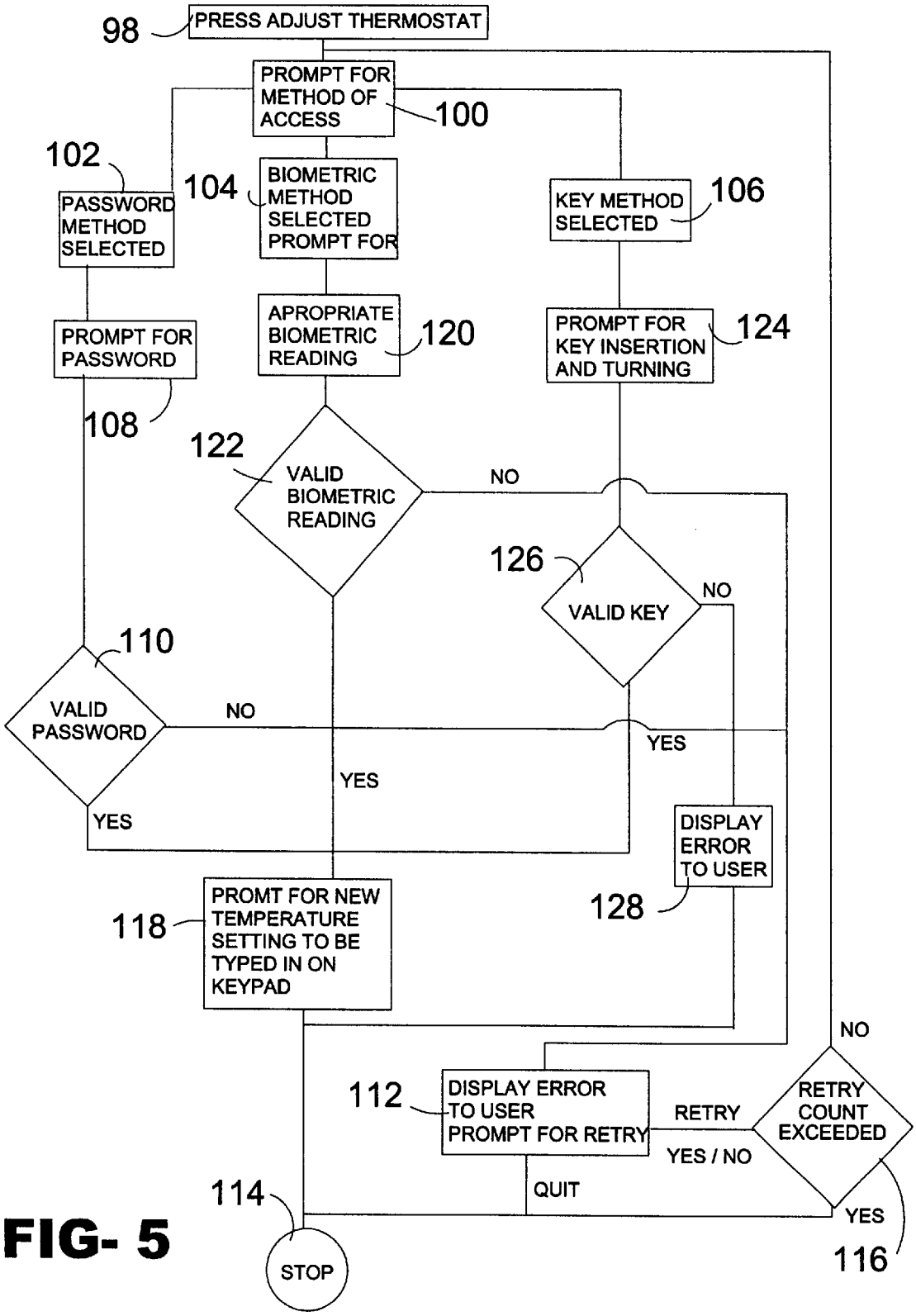
FIG. 5 is a block diagram depicting the process by which another user can access the thermostat to the adjust the temperature setting.

In regular use, it is the goal of the user 11 to change the thermostat temperature setting. In this event, the user 11 gains general access by first depressing 98 the "ADJUST THERMOSTAT" key 26. The controller then causes the control display 40 to prompt 100 for the method by which the user 11 intends to gain access. In the preferred embodiment 10, as shown in FIG. 5, these methods include password entry 102, by a permanent or temporary password, biometric entry 104, and key entry 106.

When the user 11 chooses password entry 102, the controller causes the control display 40 to prompt 108 for a password to be keyed from the keypad 22. The controller then determines 110 if the password is valid by comparing it to the permanent and temporary passwords in memory storage from the previous entries of such passwords using the master code. If the password is not valid, the controller causes the control display 40 to display 112 an error message and then prompt for a "YES" or "NO" decision as to whether to try another password. If a "NO" is keyed in, the controller terminates 114 the process. If a "YES" is keyed in, the controller then determines 116 if the number of retries exceeds the maximum number previously set using the "Set Retry Counter" function 78. In the situation where the maximum has been exceeded, the controller then terminates 114 the process. If the maximum number of retries has not been exceeded, the controller returns to the prompt 100 for "Method of Access". Alternatively, the controller can return to the prompt 102 for a password to be entered.

Once the user 11 keys in a valid password, the controller causes the control display 40 to prompt 118 for a new thermostat temperature to be keyed in from the keypad 22. When the new temperature is keyed in the controller terminates 114 the process.

If, at the prompt 100 for "Method of Access", the user 11 chooses the biometric entry 104, the controller causes the control display 40 to prompt 120 for the user 11 to input a biometric thumb print reading by placing her thumb 14 on the biometric reading device 38, as shown in FIG. 3. The controller causes the thumb print to be read and compared 122 to those biometric thumb print records previously stored in the controller memory during the function parameter modification process using the master code. If the new biometric reading matches a stored biometric record the controller causes the control display 40 to prompt 118 for a new thermostat temperature adjustment to be keyed in, and the process terminates 114 after this is done. If the biometric reading does not match a previously stored biometric record, the controller causes the control display 40 to display 112 an error message and prompt for a retry decision, as discussed above.

If the method of access chosen is key entry 106, the controller causes the control display 40 to prompt 124 for insertion of the key and manipulation of the lock mechanism 36. If the master code has previously been used to program the controller to allow key access, the controller will determine 126 that the key entry is valid and cause the control display to prompt 118 for the entry of a new thermostat temperature setting, and then terminate 114 the process. If the controller has not been set to allow key access, the controller will cause the control display 40 to display an error message and then terminate the process 114.

At any time, during any process, the user 11 can depress the "CLEAR" key 30, and the controller will terminate the then operative process.

Arrow keys 32,34 can be used to change the thermostat temperature setting by increments instead of typing in the temperature from the keypad 24.

With respect to the above description then, it is to be realized that the optimum material and dimensional relationships for the parts of the access controlled thermostat system 10, will include variations in size, materials, shape, and form, which will occur to those skilled in the art upon review of the present disclosure. For example, the housing 20 can assume varying shapes, and have different key configurations and designations. The biometric reading device 38 can be designed for finger prints, retinal scans, iris scans, voice prints, and facial images. Also, an additional lock mechanism can be added that allows the same access as the master code. A smaller number of numeric keys 24 can be utilized, as well as, the addition or substitution of alpha characters. All equivalent relationships to those illustrated in the drawings and described in the specification are intended to be encompassed by the present invention.

What is claimed as new and desired to be protected by Letters Patent set forth in the appended claims:

1. A system for a user to control a thermostat temperature setting, comprising:

a housing component enclosing the thermostat, the housing and thermostat being positioned on a hand-accessible wall;

at least one display component for displaying temperature information and control information, the temperature information including at least the actual temperature, the control information including at least prompts and messages;

an access controller component having:

a plurality of user-operated keys, the keys including at least a plurality of numeric keys;

a memory for storing and accessing information entered by the user, the information including at least a master code and a password;

the access controller component being operative to:

accept a password, the password being keyed in by the user, the display then prompting the user to key in a new thermostat temperature setting if the password matches a password stored in the memory;

reject a keyed in password if said password does not match a stored password, the display communicating the rejection;

communicate the keyed in new thermostat temperature setting to the thermostat, the thermostat being adapted to adjust the temperature setting in response to the communication; and accept a keyed in master code if the keyed in master code matches the master code stored in the memory, the display then prompting the master code user to key in the user's choice of the access controller component functions the user desires to modify, and further prompting for keyed in entries to make those modifications, the available modifications at least including:

modifying the acceptable passwords by adding new passwords or eliminating then stored passwords; and reject a keyed in master code if the keyed in master code does not match the master code stored in the memory.

2. A system for a user to control a thermostat temperature setting, comprising:

a housing component enclosing the thermostat, the housing and thermostat being positioned on a hand-accessible wall;

at least one display component for displaying temperature information and control information, the temperature information including at least the actual temperature, the control information including at least prompts and messages;

an access controller component having:

a plurality of user-operated keys, the keys including at least a plurality of numeric keys;

a biometric reading device for receiving biometric information from the user;

a memory for storing and accessing information entered by the user, the information including at least a master code, a password, and a biometric record of the user;

the access controller component being operative to:

accept a password, the password being keyed in by the user, the display then prompting the user to key in a new thermostat temperature setting if the password matches a password stored in the memory;

reject a keyed in password if said password does not match a stored password, the display communicating the rejection;

accept a biometric reading and compare the reading to the stored biometric record, the display then prompting the user to key in a new thermostat temperature setting if the biometric reading matches a biometric record stored in the memory;

reject a biometric reading if said reading does not match the stored biometric record of the user, the display communicating the rejection;

communicate the keyed in new thermostat temperature setting to the thermostat, the thermostat being adapted to adjust the temperature setting in response to the communication; and accept a keyed in master code if the keyed in master code matches the master code stored in the memory, the display then prompting the master code user to key in the user's choice of the access controller component functions the user desires to modify, and further prompting for keyed in entries to make those modifications, the available modifications at least including:

modifying the acceptable passwords by adding new passwords or eliminating then stored passwords; and modifying the biometric record by adding new biometric records or eliminating then stored biometric records;

reject a keyed in master code if the keyed in master code does not match the master code stored in the memory.

3. The system of claim 2, wherein modification of acceptable passwords includes at least the options of:

adding a new password;

eliminating a stored password;

adding a temporary password, and information determining its duration; and eliminating a temporary password, and information determining its duration.

4. The system of claim 2, wherein the available modification to the master code user also includes:

setting the time;

setting the date; and setting a schedule wherein the thermostat temperature setting is adjusted at various times and dates keyed-in by the master code user.

5. The system of claim 2, wherein the access controller component has a clearing key that, when depressed, restores the system to the un-accessed status.

6. The system of claim 2, wherein the access controller component is further operative to prompt for a keyed-in selection of the user's choice of password access or biometric access.

7. The system of claim 2, wherein the access controller component further comprises a general access key that, when depressed causes the access controller component to prompt for a keyed-in selection of the user's choice of password access or biometric access.

8. The system of claim 2, wherein the access controller component further comprises a master access key that, when depressed causes the access controller component to prompt for the master code to be keyed-in.

9. The system of claim 2, wherein the access controller component biometric reading is a thumb print, the access controller component having a biometric reading device for the thumb to contact, the device reading the thumb print and communicating the biometric reading for the comparison to the biometric record.

10. The system of claim 2, wherein the access controller component biometric reading is a finger print, the access controller component having a biometric reading device for the finger to contact, the device reading the finger print and communicating the biometric reading for the comparison to the biometric record.

11. The system of claim 2, wherein the access controller component biometric reading is a retinal scan, the access controller having a biometric reading device into which the user's close gaze is directed, the device reading the retinal scan and communicating the biometric reading for the comparison to the biometric record.

12. The system of claim 2, wherein the access controller component biometric reading is an iris scan, the access controller having a biometric reading device into which the user's close gaze is directed, the device reading the iris scan and communicating the biometric reading for the comparison to the biometric record.

13. The system of claim 2, wherein the access controller component biometric reading is a voice pattern, the access controller having a biometric reading device into which the user's voice is directed, the device reading the voice pattern and communicating the biometric reading for the comparison to the biometric record.

14. The system of claim 2, wherein the access controller component biometric reading is a facial image, the access controller having a biometric reading device at which the user's face is presented, the device reading the facial image and communicating the biometric reading for the comparison to the biometric record.

15. The system of claim 2, wherein the access controller component also has a lock mechanism and a key for manipulating the lock mechanism, the stored and accessible memory information includes an on or off status for the lock mechanism, and the access controller component is operative to:

accept a keyed manipulation of the lock mechanism if the stored lock mechanism information indicates the lock mechanism is on, the display then prompting the user to key in a new thermostat temperature setting; and reject a keyed manipulation of the lock mechanism if the stored information indicates the lock mechanism is off, the display communicating the rejection.

16. The system of claim 15, wherein the available modifications to the master code user also includes changing the on or off status for the lock mechanism.

17. The system of claim 15, wherein the access controller component further comprises a general access key that, when depressed causes the access controller component to prompt for a keyed-in selection of the user's choice of password access, biometric access, or key access.

18. A system for a user to control a thermostat temperature setting, comprising:

a housing component enclosing the thermostat, the housing and thermostat being positioned on a hand-accessible wall;

display means for displaying temperature information and control information, the temperature information including at least the actual temperature, the control information including at least prompts and messages;

access control means for controlling access to the thermostat, the access control means having:

a plurality of user-operated keys, the keys including at least a plurality of numeric keys;

biometric reading means for receiving biometric information from the user;

memory means for storing and accessing information entered by the user, the information including at least a master code, at least one password, and a biometric record of the user;

the access control means being operative to:

accept a password, the password being keyed in by the user-operable keys, the display means then prompting the user to key in a new thermostat temperature setting if the password matches a password stored in the memory;

reject a keyed in password if said password does not match a stored password, the display means communicating the rejection;

accept a biometric reading and compare the reading to the stored biometric record, the display means then prompting the user to key in a new thermostat temperature setting if the biometric reading matches a biometric record stored in the memory;

reject a biometric reading if said reading does not match a stored biometric record of the user, the display means communicating the rejection;

communicate the keyed in new thermostat temperature setting to the thermostat, the thermostat being adapted to adjust the temperature setting in response to the communication;

accept a keyed in master code if the keyed in master code matches the master code stored in the memory, the display means then prompting the master code user to key in the user's choice of the access controller function the user desires to modify, and further prompting for keyed in entries to make those modifications, the available modifications at least including:

modifying the acceptable passwords by adding new passwords or eliminating then stored passwords; and modifying the biometric record by adding new biometric records or eliminating then stored biometric records;

reject a keyed in master code if the keyed in master code does not match the master code stored in the memory.

19. The system of claim 18, wherein modification of acceptable passwords includes at least the options of:

adding a new password;

eliminating a stored password;

adding a temporary password, and information determining its duration; and eliminating a temporary password, and information determining its duration.

20. The system of claim 18, wherein the available modification to the master code user also includes:

setting the time; setting the date; and setting a schedule wherein the thermostat temperature setting is adjusted at various times and dates keyed-in by the master code user.

21. The system of claim 18, wherein the access control means has a clearing key that, when depressed, restores the system to the un-accessed status.

22. The system of claim 18, wherein the access control means is further operative to prompt for a keyed-in selection of the user's choice of password access or biometric access.

23. The system of claim 18, wherein the access control means further comprises a general access key that, when depressed causes the access control means to prompt for a keyed-in selection of the user's choice of password access or biometric access.

24. The system of claim 18, wherein the access control means further comprises a master access key that, when depressed causes the access control means to prompt for the master code to be keyed-in.

25. The system of claim 18, wherein the access control means biometric reading is a thumb print, the access control means having a biometric reading device for the thumb to contact, the device reading the thumb print and communicating the biometric reading for the comparison to the biometric record.

26. The system of claim 18, wherein the access control means biometric reading is a finger print, the access control means having a biometric reading device for the finger to contact, the device reading the finger print and communicating the biometric reading for the comparison to the biometric record.

27. The system of claim 18, wherein the access control means biometric reading is a retinal scan, the access controller having a biometric reading device into which the user's close gaze is directed, the device reading the retinal scan and communicating the biometric reading for the comparison to the biometric record.

28. The system of claim 18, wherein the access control means biometric reading is an iris scan, the access controller having a biometric reading device into which the user's close gaze is directed, the device reading the iris scan and communicating the biometric reading for the comparison to the biometric record.

29. The system of claim 18, wherein the access control means biometric reading is a voice pattern, the access controller having a biometric reading device into which the user's voice is directed, the device reading the voice pattern and communicating the biometric reading for the comparison to the biometric record.

30. The system of claim 18, wherein the access controller component biometric reading is a facial image, the access controller having a biometric reading device at which the user's face is presented, the device reading the facial image and communicating the biometric reading for the comparison to the biometric record.

31. The system of claim 18, wherein the access control means also has a lock mechanism and a key for manipulating the lock mechanism, the stored and accessible memory information includes an on or off status for the lock mechanism, and the access control means is operative to:

accept a keyed manipulation of the lock mechanism if the stored lock mechanism information indicates the lock mechanism is on, the display means then prompting the user to key in a new thermostat temperature setting;

reject a keyed manipulation of the lock mechanism if the stored information indicates the lock mechanism is off, the display means communicating the rejection.

32. The system of claim 31, wherein the available modifications to the master code user also includes changing the on or off status for the lock mechanism.

33. The system of claim 31, wherein the access control means further comprises a general access key that, when depressed causes the access control means to prompt for a keyed-in selection of the user's choice of password access, biometric access, or key access.

34. A method to control access to a thermostat at least one user in accordance with parameters set by of an operator, the thermostat being enclosed in a housing, and a controller being in electronic communication with the thermostat, in electronic communication with at least one display for displaying alphanumeric characters, and in electronic communication with user-operable keys, the controller being programmable and having a memory, the method comprising the steps of:

accepting a master code as entered by the operator using the keys;

allowing access to the controller memory if the master code is valid;

accepting the operator's choice of one function from a plurality of functions for which function parameters are to be changed, including at least the functions of setting a permanent password, setting a temporary password and its duration parameters, and setting biometric access parameters;

if the operator chose setting a permanent password, prompting for keypad entry of at least one permanent password;

accepting the operator's keypad entry of the at least one permanent password and storing the at least one permanent password in the memory;

if the operator chose setting a temporary password, prompting for keypad entry of at least one temporary password and duration determinative -keypad entries for each of the at least one temporary passwords;

accepting the operator's keypad entry of the at least one temporary password and duration determinative entries and storing the at least one temporary password and duration determinative entries in the memory;

if the operator chose setting biometric reading parameters, prompting for a biometric reading of a biometric characteristic of the at least one intended user;

accepting the biometric reading and storing the biometric reading in the memory as a biometric record;

controlling access to keypad entry of a thermostat temperature setting by a user by:

accepting the user's keypad entry of a password, if the entered password matches a stored permanent or temporary password, then accepting a keypad entry of a new thermostat temperature setting;

rejecting the user's keypad entry of a password, if the entered password does not match either a stored permanent or temporary password, then displaying the rejection;

accepting the user's provision of a biometric reading, if the biometric reading matches a stored biometric record, then accepting a keypad entry of a new thermostat temperature setting;

rejecting the user's provision of a biometric reading, if the biometric reading does not match a stored biometric record.

35. The method of claim 34, wherein a lock mechanism is in electronic communication with the controller and the functions for which parameters are changeable by the operator also include setting the controller to accept or reject a keyed manipulation of a lock mechanism such that the controller accepts a keyed manipulation of the lock mechanism by the user if the operator has set the controller to accept the same, and rejects the keyed manipulation of the lock mechanism by the user if the operator has set the controller to reject the same.

36. The method of claim 34, wherein the functions for which parameters are changeable by the operator also include:

setting the time;

setting the date; and setting a schedule wherein the thermostat temperature setting is adjusted at various times and dates keyed-in by the operator.

37. A system for a user to control a thermostat temperature setting, comprising:

a housing component enclosing the thermostat, the housing and thermostat being positioned on a hand-accessible wall;

at least one display component for displaying temperature information and control information, the temperature information including at least the actual temperature, the control information including at least prompts and messages;

an access controller component having:

a plurality of user-operated keys, the keys including at least a plurality of numeric keys;

a biometric reading device for receiving biometric information from the user;

a lock mechanism and a key for manipulating the lock mechanism, the stored and accessible memory information includes an on or off status for the lock mechanism;

a memory for storing and accessing information entered by the user, the information including at least a master code, a password, a biometric record of the user, an on or off status for the lock mechanism, a system time, a system date, a system schedule;

the access controller component being operative to:

accept a password, the password being keyed in by the user, the display then prompting the user to key in a new thermostat temperature setting if the password matches a password stored in the memory;

reject a keyed in password if said password does not match a stored password, the display communicating the rejection;

accept a biometric reading and compare the reading to the stored biometric record, the display then prompting the user to key in a new thermostat temperature setting if the biometric reading matches a biometric record stored in the memory;

reject a biometric reading if said reading does not match the stored biometric record of the user, the display communicating the rejection;

accept a keyed manipulation of the lock mechanism if the stored lock mechanism information indicates the lock mechanism is on, the display then prompting the user to key in a new thermostat temperature setting; and reject a keyed manipulation of the lock mechanism if the stored information indicates the lock mechanism is off, the display communicating the rejection;

communicate the keyed in new thermostat temperature setting to the thermostat, the thermostat being adapted to adjust the temperature setting in response to the communication; and accept a keyed in master code if the keyed in master code matches the master code stored in the memory, the display then prompting the master code user to key in the user's choice of the access controller component functions the user desires to modify, and further prompting for keyed in entries to make those modifications, the available modifications at least including:

modifying the acceptable passwords by adding new passwords, eliminating then stored passwords, adding a temporary password and information detennining its duration;

modifying the biometric record by adding new biometric records or eliminating then stored biometric records; and modifying the on or off status of the lock mechanism;

modifying the system time;

modifying the system date;

modifying the system schedule such that the thermostat temperature setting is automatically adjusted at various times and dates; and reject a keyed in master code if the keyed in master code does not match the master code stored in the memory.

* * * * *